US005167084A

United States Patent [19]

Flammier

[11] Patent Number: 5,167,084

[45] Date of Patent: Dec. 1, 1992

[54] INTERNAL TIGHTENING DEVICE FOR CROSS-COUNTRY SKI BOOT

[75] Inventor: Richard Flammier, Veyrier Du Lac, France

[73] Assignee: Salomon S.A., Chavanod, France

[21] Appl. No.: 608,468

[22] Filed: Nov. 2, 1990

[30] Foreign Application Priority Data

Nov. 22, 1989 [FR] France ..... 89 15660

[51] Int. Cl.[5] ..... A43B 5/04

[52] U.S. Cl. ..... 36/119; 36/114

[58] Field of Search ..... 36/50, 91, 114, 117, 36/118, 119, 120, 121

[56] References Cited

U.S. PATENT DOCUMENTS

| | | | |
|---|---|---|---|
| 4,550,511 | 11/1985 | Gamm | 36/119 X |
| 4,638,578 | 1/1987 | Eiteljorg, II | 36/120 X |
| 4,794,706 | 1/1989 | Puckhaber et al. | 36/91 |
| 4,811,500 | 3/1989 | Maccano | 36/119 X |
| 4,811,502 | 3/1989 | Barret | 36/119 X |
| 4,845,864 | 7/1989 | Corliss | 36/131 |
| 4,914,839 | 4/1990 | Paris et al. | 36/120 X |
| 4,947,560 | 8/1990 | Fuerst et al. | 36/91 X |

FOREIGN PATENT DOCUMENTS

| | | | |
|---|---|---|---|
| 89/04126 | 5/1989 | World Int. Prop. O. | 36/117 |

*Primary Examiner*—Paul T. Sewell
*Assistant Examiner*—Beth Anne C. Cicconi
*Attorney, Agent, or Firm*—Pollock, Vande Sande & Priddy

[57] ABSTRACT

Sport footwear (1), in particular a cross-country ski boot, comprising a device for the internal tightening of the instep area of the wearer, composed of an internal tightening quarter (5*a*) located on the inner side of the foot (1*a*), and an external tightening quarter (5*b*) located on the outer side of the foot (1*b*), these quarters (5*a*, 5*b*) being interconnected by tighteners (6), and a covering and closing upper which encloses the foot so as to cover the inner tightener. Each of the tightening quarters (5*a*, 5*b*) is assembled directly on the upper using an associated seam (10*a*, 10*b*) located above the assembly connection (80).

5 Claims, 2 Drawing Sheets

INTERNAL TIGHTENING DEVICE FOR CROSS-COUNTRY SKI BOOT

FIELD OF THE INVENTION

The purpose of the present invention is a sport boot, in particular a cross-country ski boot, comprising a device for the internal tightening of the user's instep area and composed of two tightening quarters, an internal one located on the inner side of the foot and an external one located on the outer side of the foot, an outer sole, and a covering, closing upper enclosing the foot so as to cover the internal tightening device. The closing, covering upper gives exterior water-tightness to the boot, protecting especially from snow, and avoids wear and tear of the tightening means and braking, both of which result from snow-generated friction during off-trail skiing.

BACKGROUND OF THE INVENTION

Patent FR 82.17503 discloses a boot of this kind, in which the internal tightening device is composed of two quarters surrounding the instep area. Each of these quarters is unitary with an assembly insole to which it is glued. Various layers composing the boot are also glued on the assembly insole, in particular:

a lining;
a quarter;
an upper;
sometimes, a rigid reinforcement piece located at the base of the upper; and
an outer sole.

Gluing together these four or five thicknesses requires a method termed "technical bonding." This technical bonding consists of the successive gluing of the various layers to be bonded in an area termed the assembly connection. This method prevents an intermediate layer, especially the quarters inserted between the lining and the upper and on which the user exerts substantial stresses, from sliding between the adjacent layers.

Another technique used to avoid the sliding of the layers consists in alternating the glued areas of the various layers along the assembly connection zone. This solution has the disadvantage of reducing the glued zone of each layer, if the preservation of a single assembly connection surface is desired.

Another solution consists in producing indentations on the periphery of the intermediate layers. The purpose of these indentations is to allow the glue to be deposited on each of the layers to be assembled, and, therefore, to bind these layers together. However, this solution still has the disadvantage of reducing the glued area of each layer, and particularly the area of the quarters subjected to high levels of stress caused by the sportsman or skier. The indentations thus impair the strength of the boot.

Technical gluing thus represents a long, costly manufacturing step, since it entails a large number of repeated operations, especially when the number of components requiring assembly is high.

SUMMARY OF THE INVENTION

The purpose of the present invention is to solve the problems associated with the assembly of the upper and of the internal tightening device between the assembly insole and the outer sole in a sport boot, and in particular in a cross-country ski of the above-mentioned type, i.e., in footwear comprising a device for the internal tightening of the wearer's instep area and composed of two tightening quarters, an internal quarter located on the inner side of the foot and an external quarter located on the outer side of the foot, and a covering, closing upper enclosing the foot so as to cover the internal tightening device.

In the boot according to the invention, this purpose is achieved by the fact that the two tightening quarters are assembled directly on the boot upper by a seam positioned above the assembly connection, thereby eliminating, in an advantageous manner, one gluing thickness. It allows, furthermore, a reduction of the surface area of the tightening quarters. The boot according to the invention thus requires fewer assembly operations, thereby advantageously reducing its cost. In addition, material used to make the quarters is saved.

According to one preferred embodiment, the covering upper according to the invention comprises two half-appliqués connected by a closing system. The tightening system is advantageously sewn on the corresponding half-appliqué by means of a seam located above the assembly connection and at a sufficient height to eliminate any problem of impermeability to snow.

In the case of a boot comprising rigid lateral reinforcement pieces provided to protect and maintain the position of the wearer's foot and which are sewn on the base of the upper and extend away from the assembly connection, the invention calls for the assembly of each tightening quarter to the upper by means of the same seam as the one used to assemble each lateral reinforcement piece to the upper. This arrangement makes it possible to reduce the number of assembly and sewing operations, by making a single seam which assembles the three elements together, further reducing the cost of the boot.

Furthermore, one of the tightening quarters may also be sewn to the corresponding reinforcement piece using a seam which also assembles this reinforcing piece to the upper-closing system.

BRIEF DESCRIPTION OF THE DRAWINGS

The invention will be better understood and other features will be highlighted by means of the following description made with reference to the attached schematic drawings, which illustrate several embodiments by way of example, an in which.

DESCRIPTION OF THE PREFERRED EMBODIMENTS

Figure 1:
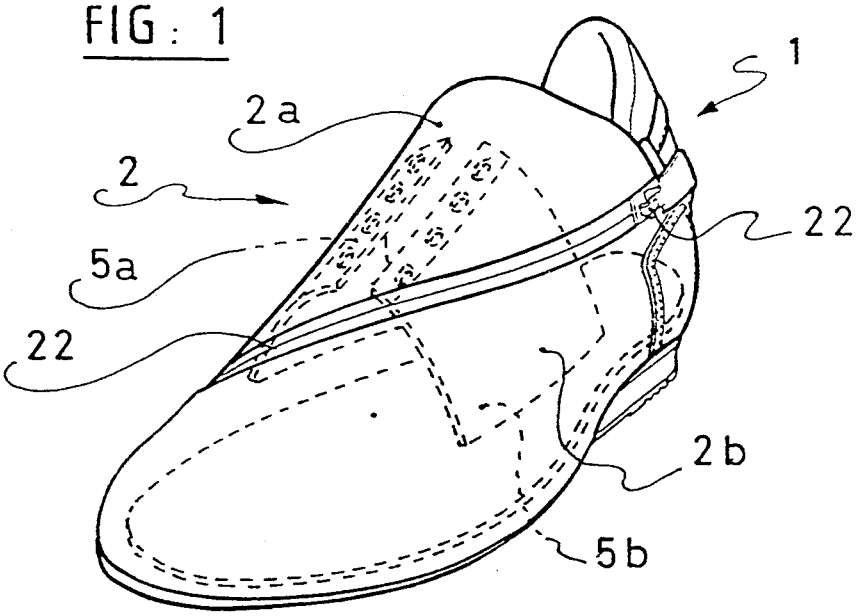
FIG. 1 is a perspective view of one embodiment of the sport boot according to the invention.

FIG. 1 illustrates a sport boot 1 comprising a device for the internal tightening of the user's instep area and composed of two tightening quarters 5*a*, 5*b*, an internal one 5*a* located on the inner side of the foot 1*a* and an external one 5*b* located on the outer side of the foot 1*b*, and a closing and covering upper 2 enclosing the foot so as to cover the internal tightening device. The upper 2 is here composed of two half-appliqués, an internal one 2*a* located on the inner side of the foot 1*a* and an external one 2*b* found on the outer side of the foot 1*b*, these two half-appliqués 2a, 2b being connected by means of a closing system 22, such as a zipper 22 or self-gripping means.

The two tightening quarters 5a, 5b, make it possible to flatten the user's foot against a sole called the clean insole (not shown in the drawings) laid down on an assembly insole 4, on which an outer sole 3 is glued by direct contact on both sides, by means of the covering upper 2.

Figure 2:
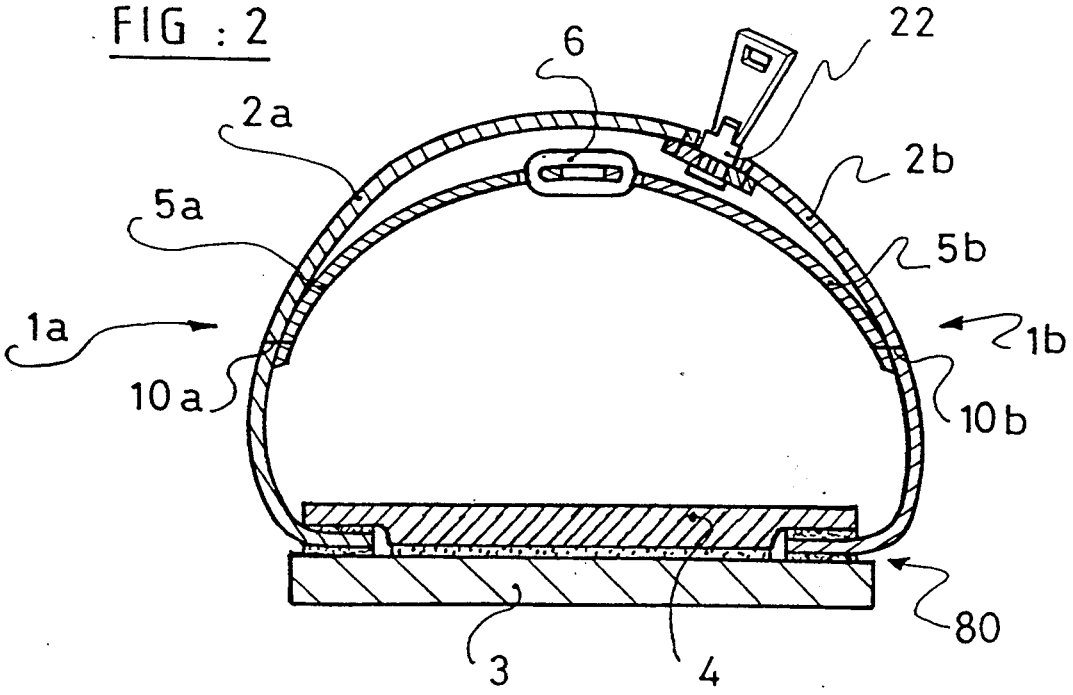
FIG. 2 is a transverse cross-section of the boot illustrated in FIG. 1.

FIG. 2 illustrates that each of the two half-appliqués 2a, 2b is, simultaneously with the assembly insole 4, glued onto the outer sole 3 in an assembly area termed the assembly connection 80.

On the other hand, the inner quarter 5a is assembled to the inner half-appliqué 2a by a means of a seam 10a located above the assembly connection 80, and the outer quarter 5b is assembled to the outer half-appliqué 2b by means of a seam 10b, also located above the assembly connection 80.

Consequently, the quarters 5a, 5b are assembled to the upper 2 independently of the assembly of the latter to the mounting insole 4, and the number of thicknesses of the elements to be assembled in the assembly connection area 80 is reduced.

According to one preferred embodiment, the seams 10a, 10b are placed at a sufficient height in relation to the contact surface between the outer sole 3 and the ski surface. This arrangement makes it possible to limit the risk that snow will penetrate into the boot 1 at the sites of these seams 10a, 10b.

Furthermore, these seams 10a, 10b will not be positioned too high above the foot, so as to give effective inner tightening.

The optimal situation is, therefore, a compromise which ensures impermeability and proper tightening, i.e., according to one preferred embodiment, at a point mid-way up the height of the upper.

The two tightening quarters 5a, 5b are connected to the top of the foot by tightening means 6 which may, for example, be composed of a lacing system or by self-gripping strips.

Figure 3:
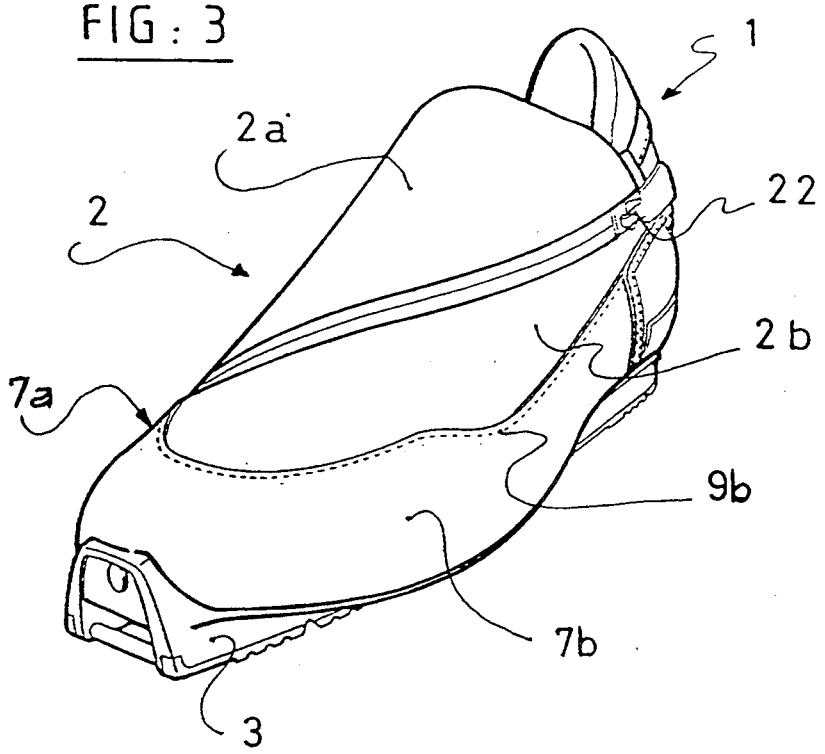
FIG. 3 is a perspective view of another embodiment of a boot according to the invention.

FIG. 3 represents a cross-country boot 1 according to the invention incorporating identical elements which bear the same reference numbers as the boot 1 shown in FIG. 1, and comprising a rigid lateral reinforcement piece 7a, 7b extending away from the assembly connection 80 on the base of the upper 2 and around the entire periphery of the boot 1.

The rigid reinforcing piece 7a, 7b comprises an internal reinforcing piece 7a located on the inner side of the foot and an external reinforcing piece 7c located on the outer side of the foot. These two pieces may be unitary and form a single reinforcing piece, as shown in FIG. 3; or, in accordance with another embodiment (not shown), they may also be separate.

Figure 4:
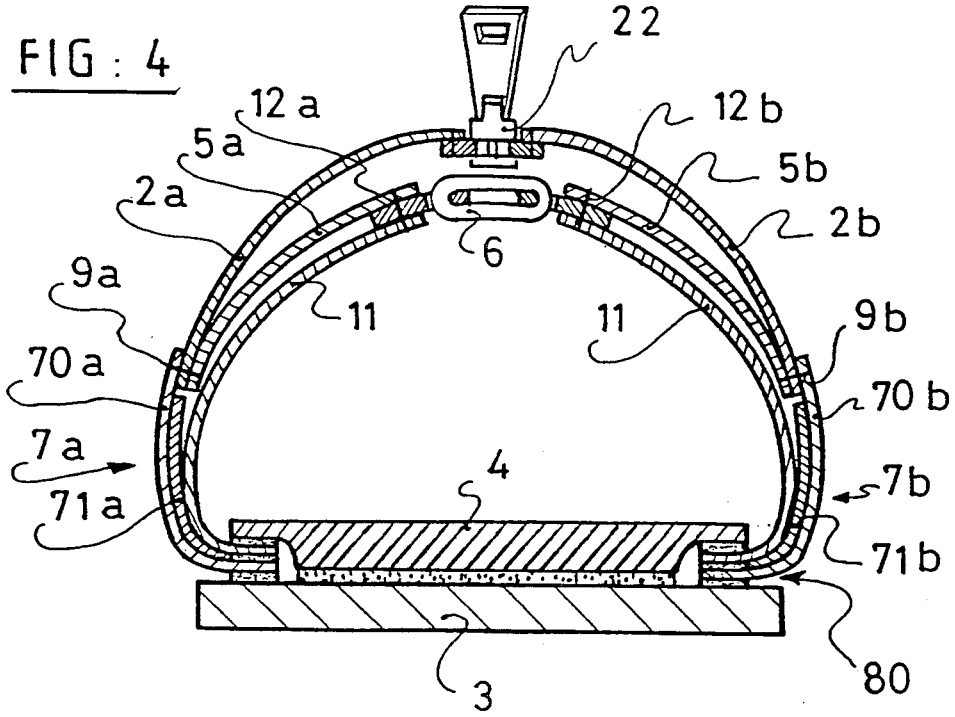
FIG. 4 is a transverse cross-section of the boot in FIG. 3.

As shown in FIG. 4 and according to one preferred embodiment, each reinforcing piece 7a, 7b comprises a leather piece 70a, 70b reinforced by a rigid thermoplastic reinforcing piece 71a, 71b glued to the inside of the corresponding leather piece 70a, 70b.

Each half-appliqué 2a, 2b is assembled to the corresponding rigid reinforcement piece 7a, 7b, in the present instance part 70, 70b of this reinforcement piece, by means of a seam 9a, 9b.

As shown in FIG. 4, the same seam 9a, 9b used to assemble each reinforcing piece 7a, 7b and its corresponding half-appliqué 2a, 2b is also advantageously used to assemble each half-appliqué 2a, 2b and each corresponding quarter 5a, 5b.

As previously described, the seam 9a, 9b is positioned above the assembly connection 80, and the number of thicknesses glued at this assembly connection is thus reduced.

Similarly, a sport boot (not shown) can be made in which the upper comprises a single appliqué which covers the tightening means.

This appliqué will, in this instance, be connected to one of the reinforcing pieces, e.g., the inner reinforcing piece 7a, by means of a seam 9a, and to the other reinforcing piece, e.g., to the outer reinforcing piece 7b, by means of a closing system 22 such as a zipper. Advantage will be gained by using a single seam 9b to assemble the reinforcing piece 7b, the zipper, and the associated tightening quarter 5b, thereby reducing again the number of seams.

As illustrated in FIG. 4, a lining 11 may be provided, in particular to protect the user's foot from the seams 9a, 9b.

In this case, the lining is interposed and glued between the assembly upper 4 and the reinforcing pieces 7a, 7b, which are, in turn, glued onto the outer sole 3.

Furthermore, the lining 11 is assembled to each of the tightening quarters 5a, 5b by means of a seam 12a, 12b.

Advantage is gained by using this same seam 12a, 12b to assemble each of the tightening quarters 5a, 5b to the tightening means 6 which connect quarters 5a, 5b.

I claim:

1. Flexible sport boot, comprising:

(a) a flexible upper;

(b) an outer sole;

(c) an assembly insole;

(d) said flexible upper, outer sole and assembly insole being separate elements assembled together in a common assembly connection zone;

(e) an inner tightening device for gripping an instep area of a foot of a wearer of said boot, said inner tightening device comprising two tightening quarters each having a first end provided with means for tightening said tightening quarters on said foot, each of said tightening quarters having a second end assembled directly on said upper by a first seam above said assembly connection zone; and (f) at least one rigid lateral reinforcement piece assembled by a second seam to said upper at least one of said tightening quarters being assembled directly on said rigid reinforcement piece located on a same side of the foot as said tightening quarter by means of the same second seam.

2. Sport boot according to claim 1, wherein each said first seam is located substantially at a mid-point of the height of said upper.

3. Sport boot according to claim 1, wherein said boot comprises a first rigid reinforcement piece located on the inner side of the foot and a second rigid reinforcement piece located at the outer side of the foot, each of said tightening quarters being assembled directly to the corresponding said rigid reinforcement piece on the same side of the foot.

4. Sport boot according to claim 3, wherein said upper comprises a single applique connected to one of said reinforcement pieces by means of a seam, and to the other said reinforcement piece by means of a closing system sewn on said reinforcement piece using the same said seam as that used to assemble the associated said tightening quarter to said reinforcement piece.

5. Sport boot according to claim 3 or 4, comprising a lining extending into an interior of said boot and having a lower edge interposed and glued between said outer sole and said assembly insole, an upper edge of said lining being assembled to said two tightening quarters by means of a third seam which also assembles each of said tightening quarters to said tightening means which attach said two tightening quarters.

* * * * *